US006233984B1

(12) United States Patent
Blehi, III

(10) Patent No.: US 6,233,984 B1
(45) Date of Patent: May 22, 2001

(54) SEMITRAILER CARGO, DOOR LOCKING SYSTEM

(76) Inventor: Andrew Blehi, III, 65860 Hwy. 60 P.O. Box 522, Salome, AZ (US) 85348

( * ) Notice: Subject to any disclaimer, the term of this patent is extended or adjusted under 35 U.S.C. 154(b) by 0 days.

(21) Appl. No.: 09/448,160

(22) Filed: Nov. 24, 1999

Related U.S. Application Data

(63) Continuation-in-part of application No. 09/327,664, filed on Jun. 8, 1999, now abandoned.

(51) Int. Cl.[7] ..... E05B 67/36
(52) U.S. Cl. ..... 70/34; 70/2; 70/56; 70/440
(58) Field of Search ..... 70/2–14, 32–34, 70/54–56, 198–202, 212, 439–441; 292/202, 205, DIG. 2, 32

(56) References Cited

U.S. PATENT DOCUMENTS

| | | | | |
|---|---|---|---|---|
| 924,331 | * | 6/1909 | Feola | 70/32 |
| 2,666,318 | * | 1/1954 | Welch | 70/440 X |
| 3,572,063 | * | 3/1971 | Foote | 70/440 X |
| 3,584,792 | * | 12/1974 | Koelle | 70/440 X |
| 4,269,048 | * | 5/1981 | McDorman | 70/34 X |
| 4,345,448 | * | 8/1982 | Solomon | 70/2 X |
| 4,512,165 | * | 4/1985 | Uyeda | 70/32 |
| 4,676,084 | * | 6/1987 | Signorelli | 70/440 |
| 4,754,626 | * | 7/1988 | Siegel | 70/32 |
| 5,118,149 | * | 6/1992 | Emmons | 70/56 X |
| 5,127,244 | * | 7/1992 | Myers | 70/2 |
| 5,469,722 | * | 11/1995 | Ellefsen | 70/34 X |
| 5,735,146 | * | 4/1998 | Taplin | 70/56 |
| 5,743,118 | * | 4/1998 | Anderson | 70/56 |
| 5,878,604 | * | 3/1999 | Stone et al. | 70/56 |
| 5,934,116 | * | 8/1999 | Moore | 70/56 X |
| 5,946,952 | * | 9/1999 | Mintchenko | 70/2 |
| 5,975,595 | * | 11/1999 | Lorenzo | 70/56 X |
| 6,010,166 | * | 1/2000 | Hamilton et al. | 70/56 X |

* cited by examiner

*Primary Examiner*—Suzanne Dino Barrett
(74) *Attorney, Agent, or Firm*—Martin L. Stoneman

(57) ABSTRACT

A semitrailer cargo door locking system is described for use with a semitrailer cargo door having as part of its opening mechanism a rotatable handle which secured within a hasp mechanism comprising a rigid lower hasp and a swivelable upper hasp. The locking system includes a shackleless keyed lock having an internal bolt for engaging aligned holes provided in the upper and lower hasps, thereby preventing unauthorized opening of the cargo doors when in a locked state. The lock housing is provided both with a protective extension to minimize attempts to pry the lock, and with a tapered side wall to prevent removal by the application of a destructive torque applied by a wrench or other like device. The lock is further provided with a anchor line for either permanently or removably securing the lock to the cargo door. To provide the lock with the ability to be used with regulated loads, a means may also be provided to attach a sealing structure to the lock.

51 Claims, 5 Drawing Sheets

FIG. 9
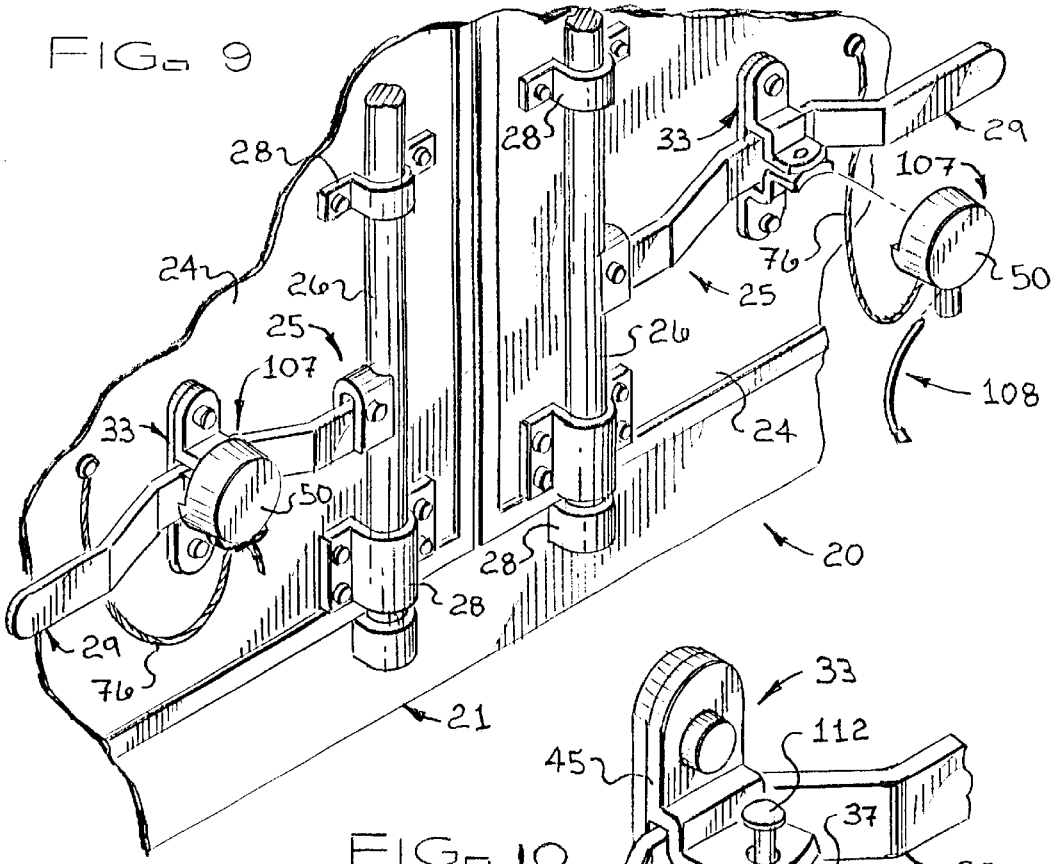
FIG. 10
PRIOR ART
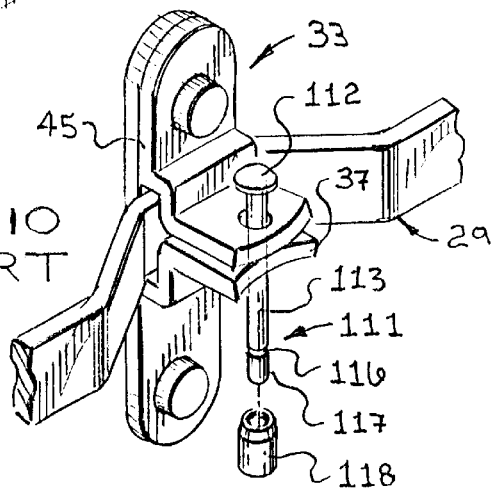
FIG. 11
PRIOR ART
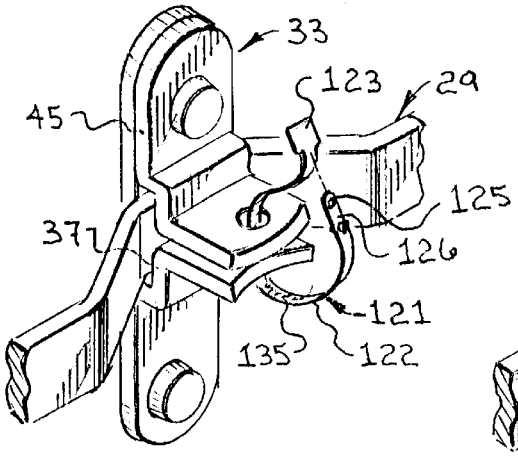
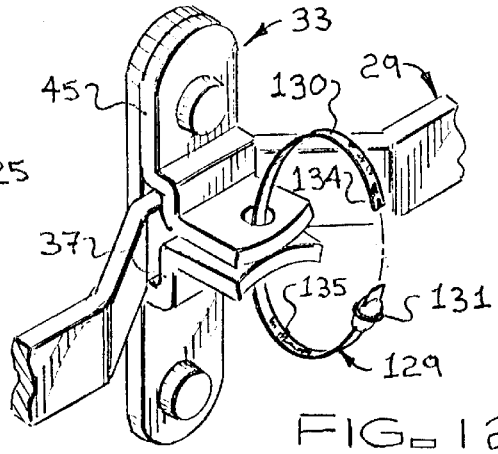
FIG. 12
PRIOR ART FIG. 13
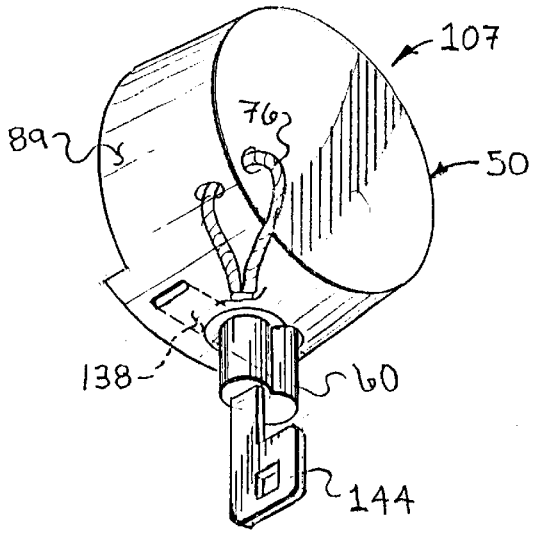
FIG. 14
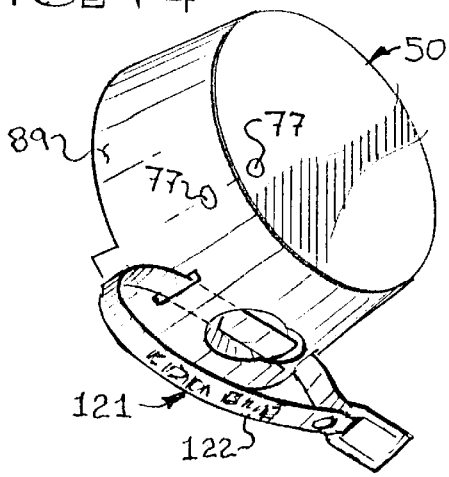
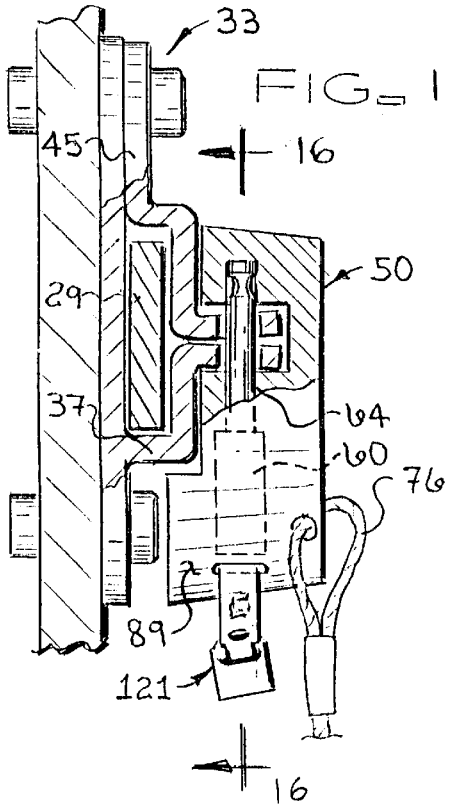
FIG. 15
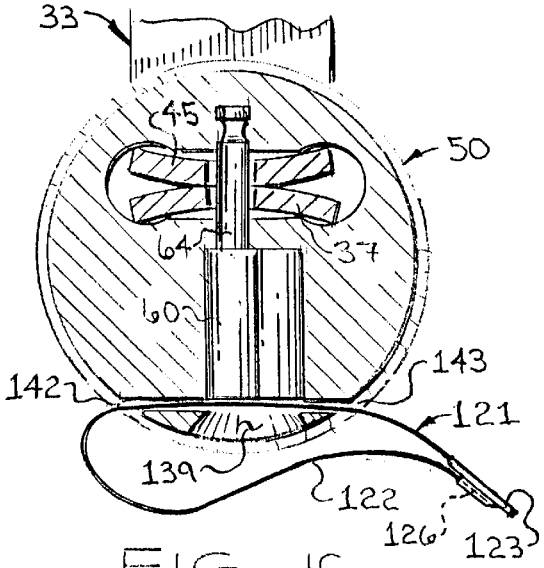
FIG. 16
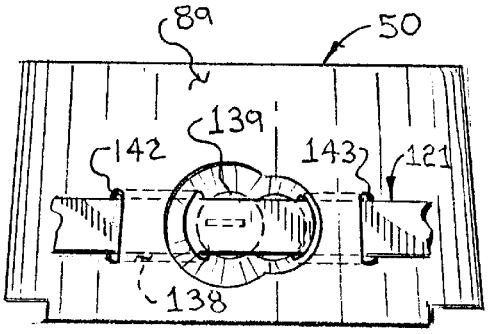
FIG. 17

FIG. 18
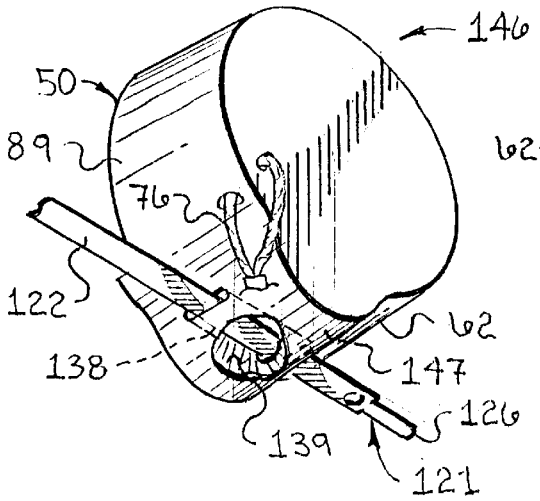
FIG. 19
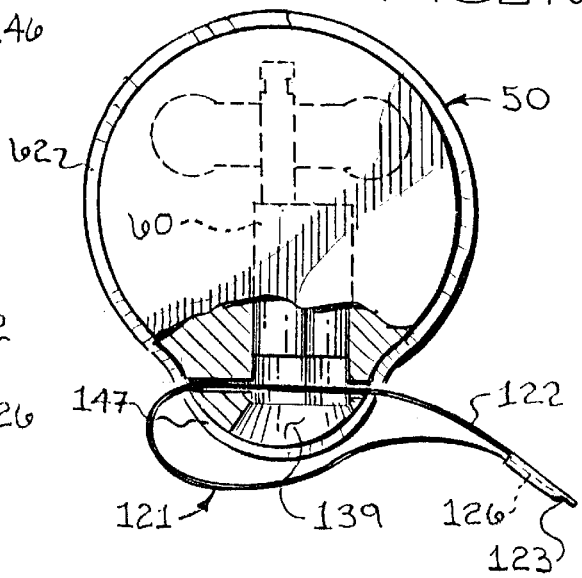
FIG. 20
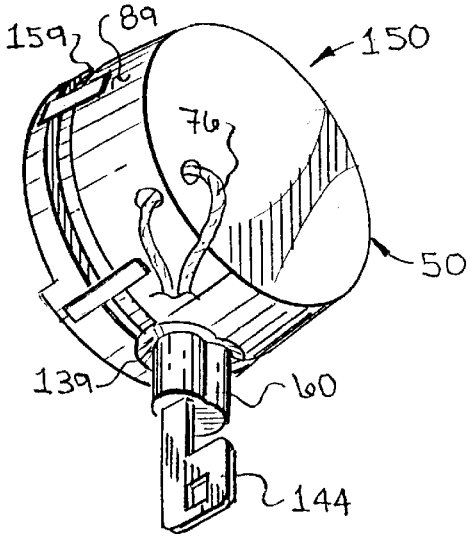
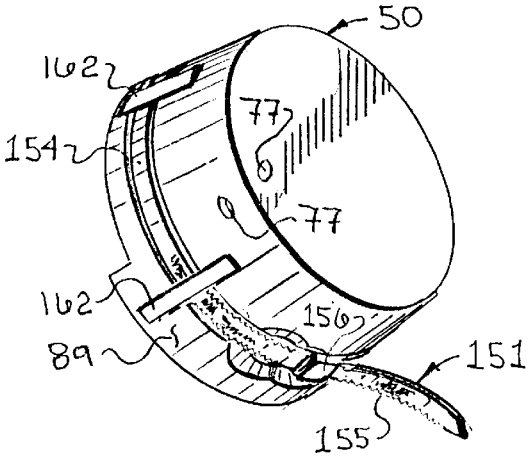
FIG. 21
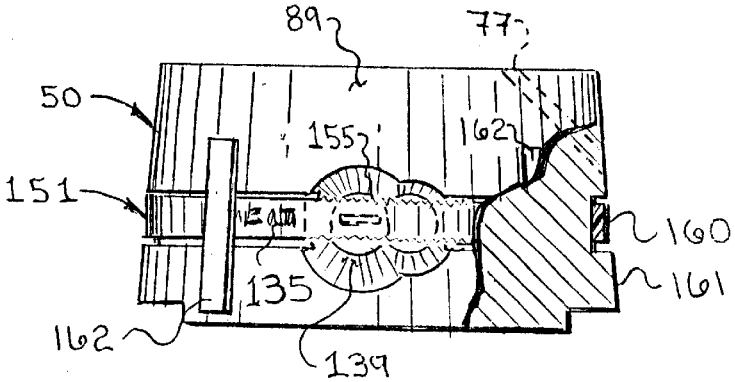
FIG. 22

SEMITRAILER CARGO, DOOR LOCKING SYSTEM

CROSS-REFERENCE TO RELATED APPLICATIONS

This application is a continuation-in-part of application Ser. No. 09/327,664, filed Jun. 8, 1999, abandoned in favor of this application.

BACKGROUND OF THE INVENTION

1. Field of the Invention

This invention relates to providing a semitrailer cargo door locking system. More particularly, this invention concerns a semitrailer cargo door locking system for mechanically locking the cargo doors of the semitrailer in a manner intended to make more difficult the unauthorized entry and theft of the semitrailer contents. In addition, this invention concerns the provision of semitrailer cargo door locking system which may be used in conjunction with a sealing structure to provide a visual indication of possible tampering of regulated loads such as, for example, alcohol, produce, and firearms.

2. Description of the Prior Art

Typically, semitrailers (herein referred to as trailers) are used to transport goods over the open roads by attaching the trailer to a semi truck (herein referred to as tractor). The cargo contained in the trailers often consists of valuable items which provides an inviting target to would-be thieves who will go to any lengths to access the trailer and obtain the cargo contained therein. Due to the fact that it is often inconvenient, impracticable, or even impossible to provide security in the form of a human presence when the trailer is not in transit, numerous other methods are often employed for safeguarding the contents of the trailers.

Typically, the trailer contents are locked by using a padlock passing through the trailer hasps holding the door handle. However, this protection method often fails, for example, by thieves using a bolt cutter to quickly cut through the shackle of the padlock. Thus, there exists an unmet need for a better system for locking such trailers.

OBJECTS OF THE INVENTION

A primary object of the present invention is to fulfill the above-mentioned need by the provision of a semitrailer cargo door locking system. A further primary object of the present invention is to provide such a system which is efficient, inexpensive, easy to use, and easy to manufacture. In addition, it is a primary object of the present invention to provide such a system in which a locking means is available either as a permanent attachment to a trailer cargo door, or may be removed by the user from the door when not in use. Furthermore, it is also a primary object of the present invention to provide such a system which may be used in conjunction with regulated loads such as alcohol, firearms, and produce.

SUMMARY OF THE INVENTION

In accordance with a preferred embodiment thereof, this invention provides a semitrailer cargo door locking system for use with a cargo door of the type having a hasp means, comprising an upper hasp and a lower hasp, for securing a door handle in a closed position, such system comprising, in combination: a housing having a back surface, a front surface, and a bottom surface; a receiving means within such housing for receiving the hasp means; and a locking means disposed within such housing for locking the upper hasp and the lower hasp within such receiving means; wherein such back surface comprises contour means for contouring such housing to the contours of the hasp means. It further provides such a system wherein such receiving means comprises a cavity formed in such back surface of such housing; and, further, wherein such cavity comprises semi-circular ends structured and arranged to permit entry of a curved hasp; and, further, wherein such semi-circular ends have a diameter of about ¾ inch.

Additionally, the present invention provides such a system wherein such locking means comprises: a key-activated tumbler; and a bolt, coupled to such tumbler and structured and arranged to be simultaneously engageable with an opening in the upper hasp and an opening in the lower hasp. And it provides such a system further comprising a mooring means for securely mooring such housing to the semitrailer; and, further, wherein such mooring means comprises a cable permanently attached to such housing and permanently attachable to the semitrailer; and, further, wherein such cable has a length of about 14 inches. It also provides such a system wherein such mooring means comprises a cable permanently attached to such housing and removably attachable to the semitrailer; and, further, wherein such cable has a length of about 28 inches.

Moreover, this invention provides such a system wherein such contour means comprises a protective portion extending upward from such bottom surface of such housing for a distance of about ¾ inch; and, further, wherein such protective portion has a thickness extending outwardly from such back surface of such housing for a distance of about ¼ inch. Even further, this invention provides such a system wherein such housing is substantially round and comprises a side surface having a larger diameter adjacent such back surface than adjacent such front surface. And, yet further, it provides for such a system wherein such housing comprises a side surface having a tumbler access opening. Also, this invention provides for such a system further comprising a receiving means for receiving a lockable flat seal of the type having an elongated body; and, wherein such receiving means comprises: a seal aperture structured and arranged to bisect such tumbler access opening; and wherein such seal aperture is structured and arranged to receive the elongated portion of the lockable flat seal. Yet further still, this invention provides for such a system wherein such receiving means comprises: a circumferential channel formed on such side surface structured and arranged to substantially bisect such tumbler access opening; and wherein such circumferential channel is structured and arranged to receive the elongated portion of the lockable flat seal.

Even additionally, according to a preferred embodiment thereof, the present invention provides a semitrailer cargo door locking system comprising, in combination: a cargo door; a handle attached to such cargo door; a hasp means for securing such handle adjacent such cargo door; a housing, attachable to such hasp means, having a back surface, a front surface, and a bottom surface; a receiving means within such housing for receiving such hasp means; and a locking means disposed within such housing for locking such hasp means within such receiving means; wherein such back surface comprises contour means for contouring such housing to align with such hasp means. And it provides such a system wherein such receiving means comprises a cavity formed in such back surface of such housing; and, further, wherein such cavity comprises semi-circular ends structured and arranged to permit entry of a curved hasp means; and, further, wherein such locking means comprises a key activated tumbler, and a bolt, coupled to such tumbler and structured and arranged to be simultaneously engageable with an opening in such hasp means.

Yet further, this invention provides such a system further comprising a mooring means for securely mooring such housing to the semitrailer; and, further, wherein such mooring means comprises a cable permanently attached to such housing and permanently attachable to the semitrailer. Also, it provides such a system wherein such mooring means comprises a cable permanently attached to such housing and removably attachable to the semitrailer. And it provides such a system wherein such contour means comprises a protective portion extending upward from such bottom surface of such housing for a distance of about ¾ inch. It also provides such a system wherein such hasp means comprises at least one hasp; and, further, wherein such housing is substantially round and comprises a side surface having a larger diameter adjacent such back surface than adjacent such front surface.

Yet further still, this invention provides for such a system wherein such housing comprises a side surface having a tumbler access opening. And it provides for such a system further comprising a receiving means for receiving a lockable flat seal of the type having an elongated body; and, wherein such receiving means comprises: a seal aperture structured and arranged to bisect such tumbler access opening; and wherein such seal aperture is structured and arranged to receive the elongated portion of the lockable flat seal. Also, it provides for such a system wherein such receiving means comprises: a circumferential channel formed on such side surface structured and arranged to substantially bisect such tumbler access opening; and wherein such circumferential channel is structured and arranged to receive the elongated portion of the lockable flat seal.

Even moreover, according to a preferred embodiment thereof, this invention provides a semitrailer cargo door locking system for use with a cargo door of the type having a hasp means comprising an upper hasp and a lower hasp for securing a door handle in a closed position, such system comprising, in combination: a housing having a back surface, a front surface, and a bottom surface; a cavity formed in such back surface of such housing, such cavity having semi-circular ends and being structured and arranged to permit entry into such housing of a curved hasp; a key activated tumbler; a bolt, coupled to such tumbler and structured and arranged to be simultaneously engageable with an opening in the upper hasp and an opening in the lower hasp; and a protective portion extending upward from such bottom surface of such housing for a distance of about ¾ inch; wherein such housing is substantially round and comprises a side surface having a larger diameter adjacent such back surface than adjacent such front surface.

Yet even further, this invention provides such a system wherein such semi-circular ends have a diameter of about ¾ inch; and, further, wherein such protective portion has a thickness extending outwardly from such back surface of such housing for a distance of about ¼ inch. And it provides such a system further comprising a cable attached to such housing and attached to the semitrailer; and, further, wherein such cable has a length of about 14 inches and is permanently attached to such housing and permanently attachable to the semitrailer. It also provides such a system wherein such cable has a length of about 28 inches and is permanently attached to such housing and removably attachable to the semitrailer. And, it provides for such a system further comprising: a seal aperture structured and arranged to bisect such tumbler access opening; wherein such seal aperture is structured and arranged to receive an elongated portion of a lockable flat seal. Additionally, it provides for such a system further comprising: a circumferential channel formed on such side surface structured and arranged to substantially bisect such tumbler access opening; and wherein such circumferential channel is structured and arranged to receive an elongated portion of a lockable flat seal.

Yet even further, according to a preferred embodiment thereof, this invention provides a semitrailer cargo door locking system for use with a cargo door of the type having a hasp means, comprising an upper hasp and a lower hasp, for securing a door handle in a closed position, such system comprising, in combination: a housing having a back surface, a front surface, and a bottom surface; a receiving means within such housing for receiving the hasp means; a locking means disposed within such housing for locking the upper hasp and the lower hasp within such receiving means; and tamper evident means, coupled to such housing, for providing a visual indication of potential unlocking of such locking means. And, this invention provides for such a system wherein such back surface comprises contour means for contouring such housing to the contours of the hasp means; and, wherein such contour means comprises a protective portion extending upward from such bottom surface of such housing for a distance of about ¾ inch.

In addition, this invention provides for such a system wherein such receiving means comprises a cavity formed in such back surface of such housing; and, further, wherein such cavity comprises semi-circular ends structured and arranged to permit entry of a curved hasp. Also, it provides for such a system further comprising a mooring means for securely mooring such housing to the semitrailer; and, further still, wherein such mooring means comprises a cable permanently attached to such housing and attachable to the semitrailer. In addition, it provides for such a system wherein such housing comprises a side surface having a tumbler access opening. And, yet further still, it provides for such a system further comprising a receiving means for receiving a lockable flat seal of the type having an elongated body.

Furthermore, this invention provides for such a system wherein such receiving means comprises: a seal aperture structured and arranged to bisect such tumbler access opening; and wherein such seal aperture is structured and arranged to receive the elongated portion of the lockable flat seal. Yet further still, it provides for such a system wherein such receiving means comprises: a circumferential channel formed on such side surface structured and arranged to substantially bisect such tumbler access opening; and wherein such circumferential channel is structured and arranged to receive the elongated portion of the lockable flat seal.

BRIEF DESCRIPTION OF THE DRAWINGS

FIG. 9 is a perspective view illustrating the cargo doors of a semitrailer, including the typical door opening and closing mechanism, and illustrating an alternate preferred embodiment of the of the semitrailer cargo door locking system of the present invention.

FIGS. 10–12 illustrate, in perspective, prior art sealing structures as attached to the cargo door hasp mechanism.

FIG. 13 is a perspective view of an alternate preferred embodiment of the locking system of the present invention.

FIG. 14 is a perspective view of the locking system embodiment of FIG. 13 with an attached sealing structure.

FIG. 15 is the locking system embodiment of FIG. 13 as attached to the cargo door hasp mechanism.

FIG. 16 is a cross sectional view, taken from section 16—16 in FIG. 15, of the locking system embodiment of FIG. 13 as attached to the cargo door hasp mechanism.

FIG. 17 is a bottom view, in partial cut-away, of the locking system embodiment of FIG. 13 with the sealing structure installed.

FIG. 18 is a perspective view of yet another alternate embodiment of the locking system of this invention illustrating the placement of the sealing structure.

FIG. 19 is a rear view, in partial cross section, of the locking system embodiment of FIG. 18.

FIG. 20 is a perspective view of yet another alternate preferred embodiment of the locking system of this invention.

FIG. 21 is a perspective view of the locking system embodiment of FIG. 20 illustrating the placement of the sealing structure.

FIG. 22 is a bottom view of the locking system embodiment of FIG. 20, in partial cut-away, also showing the placement of the sealing structure.

DETAILED DESCRIPTION OF A PREFERRED EMBODIMENT AND THE BEST MODE OF PRACTICE

Figure 1:
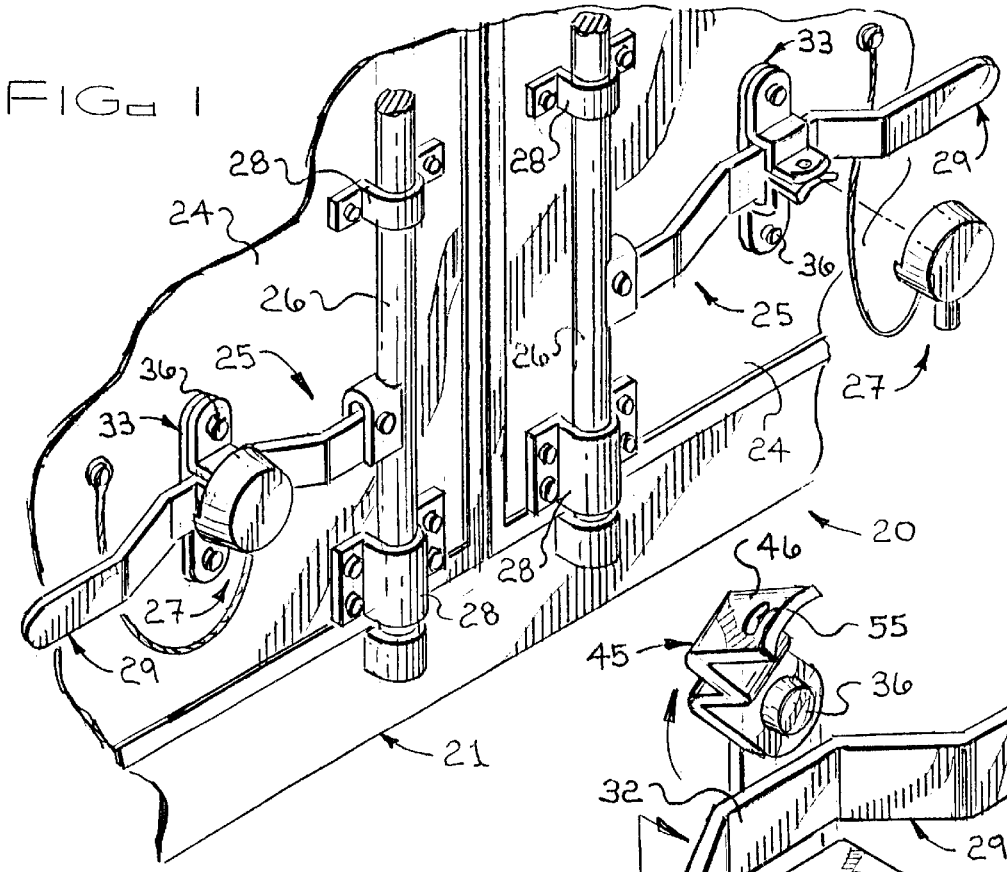
FIG. 1 is a perspective view illustrating the cargo doors of a semitrailer, including the typical door opening and closing mechanism, and illustrating a preferred embodiment of the of the semitrailer cargo door locking system of the present invention.
Figure 2:
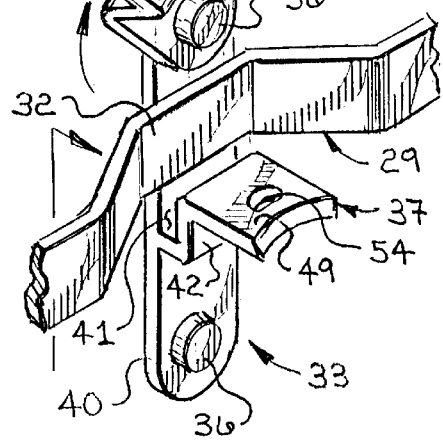
FIG. 2 is a perspective view of a typical semitrailer cargo door hasp mechanism used to secure the cargo door handle in a closed position.

Referring now to the Figures, shown in perspective in FIG. 1 is the rear portion 20 of a semitrailer 21 of the type having two cargo doors 24. To provide a means to open and close each cargo door 24, each cargo door 24 of the semitrailer 21 described herein is typically provided with a form of securing structure 25 such as the type described herein. The securing structure 25 to be used in conjunction with the semitrailer cargo door locking system 27 of the present invention comprises a stanchion 26 which is rotatably and permanently held to the cargo door 24 by use of a plurality of brackets 28. Pivotally attached to each stanchion 26 is a handle 29 having a planar central portion 32 (as shown best in FIG. 2) which is structured and arranged to engage a hasp mechanism 33 which, in turn, is typically secured to each cargo door 24 by means of mechanical fasteners 36. The hasp mechanism 33 embodies herein hasp means for securing a door handle in a closed position In order to fully appreciate the usefulness of the present invention, reference should now be made to the method of operating the securing structure 25 described herein to secure each individual cargo door 24 in a closed position. With reference now to FIG. 2, the hasp mechanism 33 comprises a lower hasp 37 which is integrally attached to base portion 40. To prevent accidental outward (e.g., away from cargo door 24) rotation of handle 29, the lower hasp 37 is structured and arranged to form a groove 41 between lower hasp intermediate portion 42 and base portion 40 of sufficient width to incorporate the width of the planar central portion 32 of handle 29. To prevent accidental dislodging of the handle 29 from the groove 41, the hasp mechanism 33 is also provided with an upper hasp 45 which is swivelably attached to base portion 40. As is well known, securing each cargo door 24 in a closed position consists of rotating the handle 29 towards the cargo door 24 until the planar central portion 32 of handle 29 contacts base portion 40. Next, the handle 29 is pivoted downwards until the planar central portion 32 is seated within groove 41. The upper hasp 45 is then swiveled downward so that the upper hasp leading portion 46 lies adjacent the lower hasp leading portion 49, thereby fully securing handle 29 to the hasp mechanism 33. As shown best in FIG. 2, each or at least one respective leading portions 46 and 49 typically comprise oppositely opposed curved members which assist in allowing the upper hasp 45 to more easily rotate into its lowermost position without catching or otherwise being hindered by the lower hasp 37.

Figure 3:
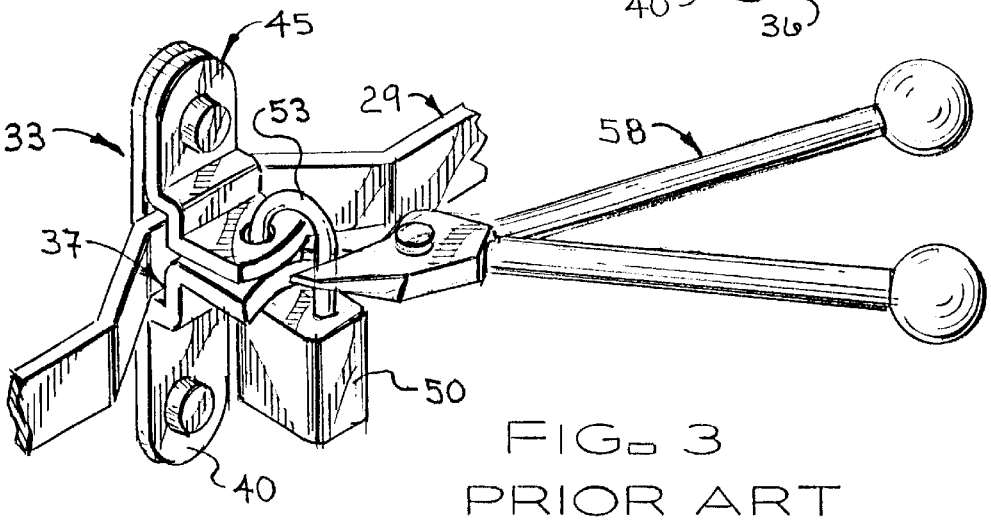
FIG. 3 PRIOR ART
FIG. 3 is a perspective view illustrating a typical prior art method of locking the cargo door handle in a closed position and a typical method of circumventing the same.

Shown in FIG. 3 is one typical prior art method of locking the handle 29 in the secured position in an attempt to prevent theft of the cargo within the semitrailer 21. Shown is a typical padlock 50 having a shackle 53 which is structured and arranged to engage openings 54 and 55 (as shown best in FIG. 2) which are typically provided in the lower and upper hasp 37 and 45, respectively. Though this is the typical method of locking the securing structure 25 of the type described herein, and such a method may be effective against "opportunity" break-ins by a thief not equipped with burglary tools who happens upon an unlocked semitrailer 21, such a method is susceptible to circumvention by a thief who is equipped with appropriate tools, such as typical bolt-cutters 58. When so equipped, the would-be thief need only use the bolt-cutters 58 to snap the shackle 53 in order to obtain access to the contents of the semitrailer 21.

Figure 4:
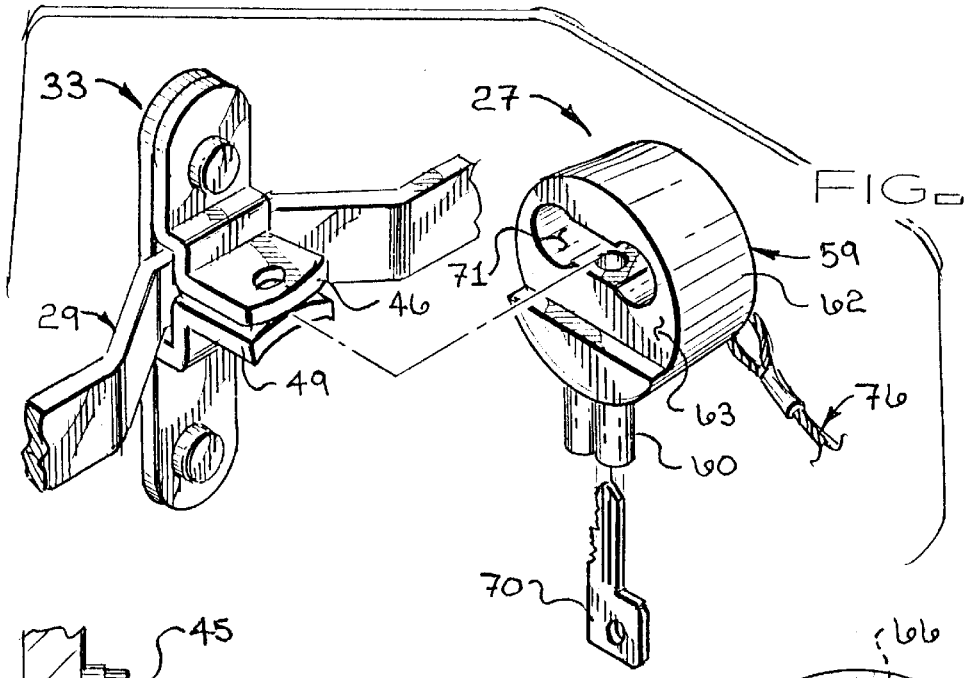
FIG. 4 is an exploded perspective view of a preferred embodiment of the locking system of this invention for use with a typical cargo door hasp mechanism.
Figure 5:
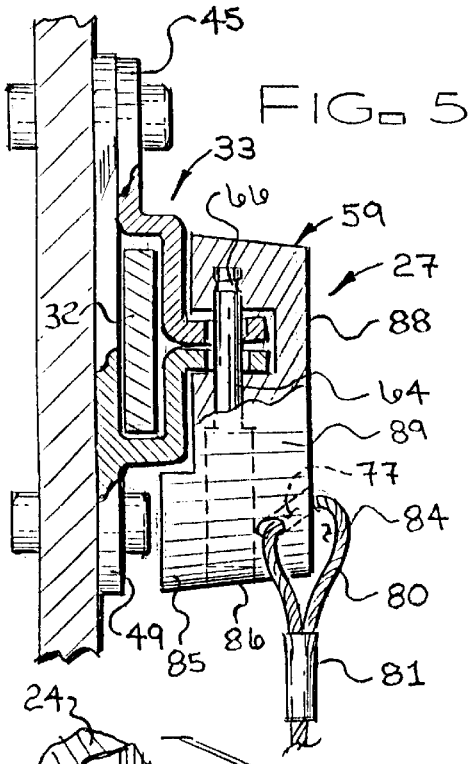
FIG. 5 is a side view, partially in cross-section, illustrating the components of the locking system of the preferred embodiment, as installed and locked on the cargo door.
Figure 6:
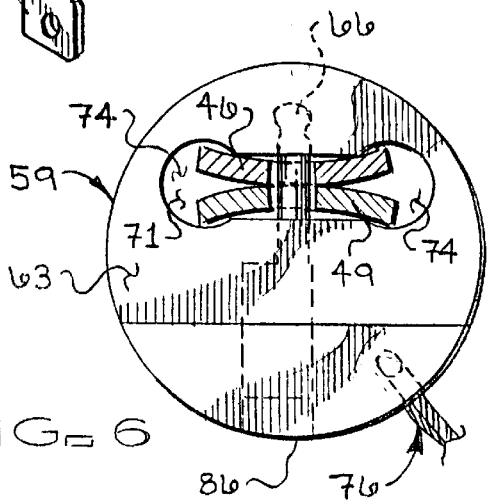
FIG. 6 is a back view illustrating a preferred configuration of the locking system recess of this invention.

Referring now to FIGS. 4–6, the details a preferred embodiment of the locking system 27 of the present invention will now be discussed. It is to be understood that, although the locking system 27 of the present invention is described herein for use on semitrailer cargo doors 24, such showing is the illustrated preferred embodiment only; and this invention may often also be used in conjunction with overseas containers, military shipping vans or the like. In addition, for those shipments consisting of regulated products such as alcohol, explosives, or the like, the locking system 27 is designed to meet or exceed the specifications for such systems as promulgated by the Bureau of Alcohol, Tobacco, and Firearms.

The locking system 27 comprises a lock 59, preferably a shackleless type lock of the type having a retractable tumbler 60 which, when the lock is in a locked state, is disposed within, and protected by, the lock housing 62. The lock housing 62, in turn, has a substantially round circumference and has a diameter at the lock back surface 63 of approximately $2\frac{15}{16}$ inches. To withstanding blows from a hammer or similar device, the lock housing 62 is preferably constructed out of a hard and durable material, preferably steel or aluminum or other like. Coupled to the tumbler 60 is bolt 64 (as shown best in FIG. 5) which is structured and arranged to engage the openings 54 and 55 provided in, respectively, the lower and upper hasps 37 and 45. The bolt 64 is typically provided with a locking end 66 which is structured and arranged to engage, in well known ways, a corresponding locking structure (not shown) incorporated within lock housing 62. Unlocking the lock 59 of the present invention consists of inserting a key 70 within the tumbler 60 and then rotating the key 70 until the locking end 66 is disengaged from the locking structure. Thus, in well known ways, upon disengagement, the bolt 64 and tumbler 60 combination retract so that no part of bolt 64 is disposed within the cavity 71 (embodying herein a receiving means within such housing for receiving the hasp means) provided in the lock back surface 63. The tumbler and bolt combination embody herein a locking means disposed within such housing for locking the upper hasp and the lower hasp within such receiving means, and wherein such locking means comprises: a key-activated tumbler, and a bolt, coupled to such tumbler and structured and arranged to be simultaneously engageable with an opening in the upper hasp and an opening in the lower hasp.

As mentioned previously, formed within the lock back surface 63 is a cavity 71 which is structured and arranged to receive the upper and lower hasp leading portions 46 and 49 when these hasp portions are arranged as shown in FIG. 4. To more easily receive those upper and lower hasps 45 and 37 having typically at least one hasp curved leading portions 46 and 49, such as shown in FIGS. 4–6, the cavity 71 is preferably provided with semicircular ends 74, each having a preferred diameter of approximately 13/16-inch, thereby comprising a sort of "dogbone"-shaped such cavity. This arrangement embodies herein an arrangement wherein such cavity comprises semi-circular ends structured and arranged to permit entry of a curved hasp means; and further wherein such back surface comprises contour means for contouring such housing to the contours of the hasp means. Though the preferred shape of the cavity 71 as described herein is preferred in order to fully accommodate the typical hasps as described previously, it is to be understood that the cavity 71 shaped as described performs equally well with hasps having substantially planar leading portions.

Also shown in FIG. 4 is the use of an anchor line 76, preferably comprising an approximately 1/8-inch-diameter cable made of woven strands of steel or aluminum. As will be discussed more fully with respect to FIGS. 7 and 8, the anchor line 76 is used in the illustrated preferred embodiment to prevent the loss of the lock 59 and/or damage to trailing vehicles when the semitrailer 21 is in transit should the lock 59 become unlocked or otherwise fail. As shown best in FIG. 5, the lock housing 62 is provided with an aperture 77 which is sized to receive the first end 80 of anchor line 76. Securing the anchor line 76 to the lock housing 62 consists of simply threading the first end 80 through the aperture 77 and then securely attaching the first end 80 to anchor line 76 by use of a cable-type connector 81 or other like device, thereby forming a secure first loop 84. As will be discussed more fully with respect to FIGS. 7 and 8, the anchor line 76 is securely attached to a supporting structure on the semitrailer 21, thereby helping prevent the aforementioned accidental loss of lock 59. The anchor line 76 embodies herein a mooring means for securely mooring such housing to the semitrailer.

Shown in FIG. 5 is a side view, in partial cut-away, of the lock 59 installed on the hasp mechanism 33 and in a locked state. To make more difficult the unauthorized removal of the lock 59 from the hasp mechanism 33, the locking system 27 of the preferred embodiment of the present invention provides for additional safety features. To prevent a would-be thief from prying the lock 59 off the hasp mechanism 33 by using a crow-bar or other like device, the lock 59 of the preferred embodiment of the present invention is provided (as shown) with an integrally formed protective extension 85 formed on lock back surface 63 and extending upward from the lock bottom surface 86. As shown best in FIG. 5, the protective portion 85 is contoured in such a manner as to substantially match the contours of lower hasp 37. To prevent any interference with proper alignment between the hasps 37 and 45 and cavity 71, it is preferred that protective extension 85 have a maximum width of about 3/4 inch and a thickness of about 1/4 inch, thereby yielding a maximum thickness of lock 59 of approximately 1½ inches (embodying herein an arrangement wherein such back surface comprises contour means for contouring such housing to align with such hasp means). As used herein, "thickness" refers to outward extension of the protective portion 85 from the back surface 63 of the lock housing 62.

It is to be understood that all referenced dimensions disclosed herein for the locking system 27 are with reference to the shape and configuration of securing structure 25, handles 29, and cargo doors 24 which have been found to be typical of the semitrailer cargo doors described herein. In addition, as will be appreciated by those skilled in such art, by configuring the locking system 27 in accordance with the typical cargo door dimensions and configurations, the locking system 27 of the present invention provides a very-efficient "universal" system in which one preferred size fits all.

In addition, to prevent a would-be thief from applying a destructive torque to the hasp mechanism 33 by use of a pipe wrench or similar device, it is preferred that the diameter of the lock 59 adjacent the lock front surface 88 be smaller than the diameter adjacent the lock back surface 63 in order to provide the side surface 89 of lock housing 62 with a taper. Such an arrangement provides the lock 59 with a substantially truncated cone shape, as shown best in FIG. 5. As will be appreciated by those skilled in the art, by providing the side surface 89 with a taper, it is more difficult for all the teeth of a pipe wrench to engage the housing material, thereby making it more difficult to apply a damaging torque to the lock 59 and/or hasp mechanism 33.

Figure 7:
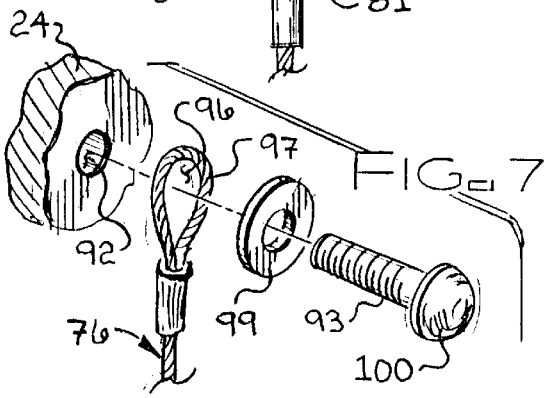
FIG. 7 is an exploded perspective view of a preferred method of securing the locking system to a semitrailer cargo door.

Shown in FIG. 7 is a preferred method of mooring or anchoring the lock 59 of the present invention to the semitrailer 21. Shown specifically is a portion of a cargo door 24 which is provided with an opening 92 sized to receive a mechanical fastener 93, preferably comprising a threaded fastener, though other fastener types such as a rivet may be used without detracting from the spirit of the present invention. As shown, the fastener 93 is structured and arranged to pass through a second loop 96 formed on the second end 97 of the anchor line 76 and, when the fastener 93 is fully engaged within opening 92, the anchor line 76, and hence the lock 59, is securely and permanently moored to the cargo door 24 (all as shown best in FIG. 1). For use in the present embodiment, it is preferred that anchor line 76 have a length of approximately 14 inches, though other lengths may be chosen depending on the distance between the attachment point of the fastener 93 and the lock 59. As is also shown, a flat washer 99 of a suitable size may be provided between the second loop 96 and fastener head 100 in order to provide a more secure mooring. This arrangement embodies herein an arrangement wherein such mooring means comprises a cable permanently attached to such housing and permanently attachable to the semitrailer.

Figure 8:
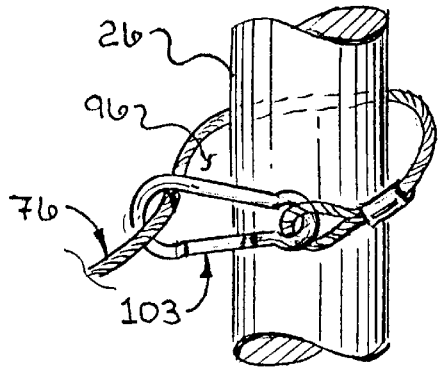
FIG. 8 is a front view illustrating an alternate preferred method of securing the locking system to the cargo door.

An alternate preferred method of anchoring the lock 59 of the present invention to the semitrailer 21 is as shown in FIG. 8. As shown, the second loop 96 of anchor line 76 may be provided with a quick-release-type clasp 103, of the type commercially available and readily selected by one skilled in the art. The lock 59 may be releasably moored to the semitrailer 21 by looping the second loop 96 around a stanchion 26 and placing, in well known ways, the anchor line 76 within the clasp 103. To ensure that the anchor line 76 has sufficient slack to allow the lock 59 to be easily removed from the hasp mechanism 33, it is preferred and recommended that the anchor line have a length of approximately 28 inches. This arrangement embodies herein an arrangement wherein such mooring means comprises a cable permanently attached to such housing and removably attachable to the semitrailer.

With reference now to FIGS. 9–17, the details of an alternate preferred embodiment of the locking system 107 will now be discussed. Shown in perspective in FIG. 9 is the rear portion 20 of a semitrailer 21 as substantially illustrated and described with respect to FIG. 1. The locking system 107 of the present invention comprises padlock 50 also having an attached anchor line 76 with the details of the anchor line 76 being fully elaborated upon previously. The locking system 107 further comprises a sealing structure designated generically herein by reference numeral 108, the details of which will be more fully discussed as this disclosure progresses. However, prior to describing the present embodiment of the locking system 107, the motivations surrounding the present embodiment should now be briefly mentioned. In order to transport regulated cargo such as, for example, alcohol, produce, and firearms requires that a means be provided which provides a visual indication that the load may have been tampered with. Examples of such typically used prior art means to provide this visual indication are as shown in FIGS. 10–12. Shown in FIG. 10 is a bolt seal 111, typically made of steel or the like, comprising a head portion 112 and an elongated shaft 113 sized to engage the openings 54 and 55 (as shown best in FIG. 2) in the respective lower and upper hasps 37 and 45 when the hasp mechanism 33 is arranged as shown. A circumferential groove 116 is provided adjacent end 117 and is structured and arranged to engage, in well-known ways, locking cap 118. When the locking cap 118 is attached to end 117, it may not be removed without destroying the bolt seal 111.

FIGS. 11 and 12 illustrate two other examples of typical sealing structures. Shown in FIG. 11 is a typical flat seal 121 comprising a substantially flat elongated portion 122 having a substantially square planar female end 123 which is structured and arranged to receive, in well-known ways, an aperture 125 provided on male end 126. Once engaged, the ends 123 and 126 cannot be uncoupled without destroying the flat seal 121. And shown in FIG. 12 is another example of a flat seal 129 also comprising an elongated portion 130 and having a substantially bulbous-like planar female end 131 which is structured and arranged to receive, in well-known ways, male end 134. As described above with respect to flat seal 121, once engaged, the ends 131 and 134 cannot be uncoupled without destroying the flat seal 129. Each respective elongated portion 122 and 130 is sized to engage the openings 54 and 55 (as shown best in FIG. 2) in the respective lower and upper hasps 37 and 45 when the hasp mechanism 33 is arranged as shown. The flat seals 121 and 129 described herein are typically constructed from a durable material such as steel or nylon and each elongated portion 122 and 130 is typically available in a variety of lengths and each has a typical width of about ⅜-inch.

The operation of each of the aforementioned seals 111, 121, and 129 is well-known by those skilled in such art and will only be elaborated on briefly herein. Upon locking each respective above-described sealing structure to the hasp mechanism 33 in the aforementioned manner, each sealing structure may henceforth only be removed by destroying the sealing structure as by cutting the shaft 113 or elongated portions 122 and 130. Once destroyed, the sealing structure cannot be reattached to conceal the visual evidence that the load may have been tampered with. To ensure that a would-be thief cannot simply replace the destroyed sealing structure with a counterfeit, the applicable regulatory policy requires each sealing structure to have imprinted thereon identification indicia 135 (as shown best in FIGS. 11 and 12).

With reference to FIGS. 13–17, the details of the alternate preferred embodiment of the locking system 107 of this invention will now be discussed. For exemplary purposes only, the locking system 107 is illustrated and described herein for use with flat seal 121, though it is to be understood that the present invention may also be practiced with other sealing structures having an elongated portion 122 of the type associated with flat seal 121 (e.g., such as flat seal 129). To utilize the locking system 107 with the flat seal 121 according to this invention, requires the padlock 50 is provided with a seal aperture 138 which is structured and arranged to bisect tumbler access aperture 139 (as shown best in FIG. 16). For simple and rapid attachment of the flat seal 121 when the padlock 50 is attached to the hasp mechanism 33, it is preferred that the seal aperture 138 be arranged so that the first opening 142 and the second opening 143 lie along the side surface 89 of padlock 50 on opposing sides of the tumbler access aperture 139 (as shown best in FIG. 17). As shown in the FIG. 16 cross-sectional view, it is also preferred that seal aperture 138 be substantially straight to facilitate the receipt of the elongated portion 122 and have a preferred width of about 0.0050 inches which corresponds to about three times the width of the typical elongated portions 122 and 130 described herein. The seal aperture 138 embodies herein a receiving means for receiving a lockable flat seal of the type having an elongated body.

Referring further to FIG. 16, attachment of the flat seal 121 to the padlock 50 consists of first attaching the padlock 50 to the hasp mechanisms 33 in the manner hereinbefore described. Next, the male end 126 is inserted into, for example, second opening 143 and pushed through the seal aperture 138 until the male end 126 exits the first opening 142, at which point the ends 123 and 126 are then coupled in a well-known manner. This arrangement embodies herein an arrangement wherein such seal aperture is structured and arranged to receive the elongated portion of the lockable flat seal. As will be appreciated by those skilled in such art, when the flat seal 121 is attached to the padlock 50 in the aforementioned manner, the flat seal 121 substantially covers access to the tumbler 60 (as shown best in FIG. 17) thereby preventing a would-be thief from using either a duplicate key 144 (shown in FIG. 13) or lock-picking tools to retract the tumbler 60 without first having to destroy the flat seal 121. This system with the flat seal 121 embodies herein tamper evident means, coupled to such housing, for providing a visual indication of potential unlocking of such locking means.

Referring now to FIGS. 18–19, another alternate embodiment of the locking system of the present invention, designated herein by reference numeral 146, will now be discussed. Again, shown is the padlock 50 provided with the seal aperture 138 structured and arranged to receive flat seal 121. For those padlocks 50 of the type described herein, it may be necessary to modify the lock housing 62 adjacent the tumbler access aperture 139 in order to provide a substantially straight seal aperture 138 (as shown best in FIG. 19). As shown, one preferred such modification consists of providing an outwardly protruding prominence 147 which is milled or otherwise permanently formed on the side surface 89 adjacent the tumbler access aperture 139 and sized to at least accommodate the aforementioned preferred thickness of the seal aperture 138. By providing such a prominence 147, there should exist sufficient room to provide the padlock 50 with the aforementioned substantially straight seal aperture 138 without the need to modify the internal placement of the tumbler 60. Attachment of the flat seal 121 to the padlock 50 is accomplished in substantially the same manner as described above with respect to the alternate embodiment illustrated and described in FIGS. 13–17 and consists of first locking the padlock 50 to the hasp mechanism 33 and then inserting the male end 126 though the seal aperture 138 and coupling, in well-known ways, the male and female ends 126 and 123 together.

Referring now to FIGS. 20–22, shown is yet another alternate embodiment of the locking system of this invention designated herein by reference numeral 150. The locking system 150 is structured and arranged to be used with a flat seal 151, shown in FIGS. 21 and 22, of the type typically comprising a plastic or nylon-type material and having an elongated portion 154 with identification indicia 135 provided thereon. The elongated portion 154, in turn, comprises serrated edges 155 which are structured and arranged to engage, in well-known ratchet-like ways, the female end portion 156. The flat seal 151, in turn, is structured and arranged to engage a circumferential seal channel 159 provided on the side surface 89 of padlock 50 by machining or other like methods. The seal channel 159 embodies herein a receiving means for receiving a lockable flat seal of the type having an elongated body; and, wherein such circumferential channel is structured and arranged to receive the elongated portion of the lockable flat seal.

As shown best in FIG. 22, the seal channel 159 is structured and arranged to bisect tumbler access aperture 139, thereby preventing access to the tumbler 60 without first destroying the flat seal 151. In order to prevent a would-be thief from prying the flat seal 151 from the seal channel 159 and replacing it so as to avoid evidence of tampering, it is preferred that the depth of the seal channel 159 be sufficient to fully receive the elongated portion 154 in such manner that the elongated portion outer surface 160 is at least flush with, and most preferably slightly receded from, the side wall surface 161. The flat seal 151 embodies herein tamper evident means, coupled to such housing, for providing a visual indication of potential unlocking of such locking means; and the housing also embodies such seal channel being at least as deep as the maximum thickness of such flat seal. Alternatively, a plurality of retainers 162, preferably comprising a metallic material having preferred dimensions of about ⅜-inch wide by ¾-inch long by ¼-inch thick may be attached, preferably integrally, at approximate equidistant locations along side surface 89 in such manner as to bisect seal channel 159, as shown. The provision of retainers 162 further inhibits the removal of flat seal 151 from the seal channel 159 such as by prying or the like. The retainers embody herein a retaining means for retaining the flat seal within said circumferential channel. To allow for unobstructed sliding of the flat seal 151 into the seal channel 159, it is preferred that the depth of seal channel 159 be such that the outer surface 160 of the elongated portion 154 is at least flush with, and most preferably slightly receded from, the side wall surface 161.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent from the descriptions and the claims.

What is claimed is:

1. A semitrailer cargo door locking system for use with a cargo door of the type having a hasp means, comprising an upper hasp and a lower hasp, for securing a door handle in a closed position, said system comprising, in combination:

(a) a shackleless lock housing having a back surface, a front surface, and a bottom surface;

(b) a first receiving means within said shackleless lock housing for receiving the hasp means; and (c) a locking means, comprising a locking bolt, disposed within said shackleless lock housing for locking, with said locking bolt, the upper hasp and the lower hasp within said receiving means;

(d) wherein said locking means comprises:

(i) a key-activated tumbler; and (ii) said locking bolt, coupled to said tumbler and structured and arranged to be simultaneously engageable with an opening in the upper hasp and an opening in the lower hasp; and (e) wherein said first receiving means comprises contour means for contouring said back surface of said shackleless lock housing to receive the hasp means into a position of engageability with said locking bolt.

2. The system of claim 1 wherein said first receiving means comprises a cavity formed in said back surface of said shackleless lock housing.

3. The system of claim 2 wherein said cavity comprises semicircular ends structured and arranged to permit entry of a curved hasp.

4. The system of claim 3 wherein said semi-circular ends have a diameter of about ¾ inch.

5. The system of claim 1 further comprising a mooring means for securely mooring said shackleless housing to the semitrailer.

6. The system of claim 5 wherein said mooring means comprises a cable permanently attached to said shackleless housing and permanently attachable to the semitrailer.

7. The system of claim 6 wherein said cable has a length of about 14 inches.

8. The system of claim 5 wherein said mooring means comprises a cable permanently attached to said shackleless housing and removably attachable to the semitrailer.

9. The system of claim 8 wherein said cable has a length of about 28 inches.

10. The system of claim 1 wherein said contour means comprises a protective portion extending upward from said bottom surface of said shackleless housing for a distance of about ¾ inch.

11. The system of claim 10 wherein said protective portion has a thickness extending outwardly from said back surface of said housing for a distance of about ¼ inch.

12. The system of claim 1 wherein said shackleless housing is substantially rounded and comprises a side surface having a larger diameter adjacent said back surface than adjacent said front surface.

13. The system of claim 1 wherein said shackleless housing comprises a side surface having a tumbler access opening.

14. The system of claim 13 further comprising a second receiving means for receiving a lockable flat seal of the type having an elongated body.

15. The system of claim 14 wherein said second receiving means comprises:

(a) a seal aperture structured and arranged to bisect said tumbler access opening; and (b) wherein said seal aperture is structured and arranged to receive the elongated portion of the lockable flat seal.

16. The system of claim 14 wherein said second receiving means comprises:

(a) a circumferential channel formed on said side surface structured and arranged to substantially bisect said tumbler access opening; and (b) wherein said circumferential channel is structured and arranged to receive the elongated portion of the lockable flat seal.

17. A semitrailer cargo door locking system comprising, in combination:

(a) a semitrailer comprising a cargo door;

(b) a handle attached to said cargo door;

(c) a hasp means for securing said handle adjacent said cargo door;

(d) a shackleless lock housing, attachable to said hasp means, having a back surface, a front surface, and a bottom surface;

(e) a first receiving means within said shackleless lock housing for receiving said hasp means; and (f) a locking means, comprising a locking bolt coupled to a key-activated tumbler, disposed within said shackleless lock housing for locking, with said locking bolt, the upper hasp and the lower hasp within said receiving means;

(g) wherein said locking means comprises:

(i) a key-activated tumbler; and (ii) said locking bolt, coupled to said tumbler and structured and arranged to be simultaneously engageable with an opening in the upper hasp and an opening in the lower hasp; and (h) wherein said first receiving means comprises contour means for contouring said back surface of said shackleless lock housing to receive the hasp means into a position of engageability with said locking bolt.

18. The system of claim 17 wherein said first receiving means comprises a cavity formed in said back surface of said housing.

19. The system of claim 18 wherein said cavity comprises semi-circular ends structured and arranged to permit entry of a said hasp means where said hasp means is curved.

20. The system of claim 17 further comprising a mooring means for securely mooring said shackleless lock housing to said semitrailer.

21. The system of claim 20 wherein said mooring means comprises a cable permanently attached to said shackleless lock housing and permanently attachable to the semitrailer.

22. The system of claim 20 wherein said mooring means comprises a cable permanently attached to said shackleless lock housing and removably attachable to said semitrailer.

23. The system of claim 17 wherein said contour means comprises a protective portion extending upward from said bottom surface of said shackleless lock housing for a distance of about ¾ inch.

24. The system of claim 17 wherein said hasp means comprises at least one hasp.

25. The system of claim 17 wherein said shackleless lock housing is substantially round and comprises a side surface having a larger diameter adjacent said back surface than adjacent said front surface.

26. The system of claim 17 wherein said shackleless lock housing comprises a side surface having a tumbler access opening.

27. The system of claim 26 further comprising a second receiving means for receiving a lockable flat seal of the type having an elongated body.

28. The system of claim 27 wherein said second receiving means comprises:

(a) a seal aperture structured and arranged to bisect said tumbler access opening; and (b) wherein said seal aperture is structured and arranged to receive the elongated portion of the lockable flat seal.

29. The system of claim 27 wherein said second receiving means comprises:

(a) a circumferential channel formed on said side surface structured and arranged to substantially bisect said tumbler access opening; and (b) wherein said circumferential channel is structured and arranged to receive the elongated portion of the lockable flat seal.

30. A semitrailer cargo door locking system for use with a cargo door of the type having a hasp means comprising an upper hasp and a lower hasp for securing a door handle in a closed position comprising, in combination:

(a) a housing having a back surface, a front surface, a bottom surface, a side surface, and having a tumbler access opening;

(b) a cavity formed in said back surface of said housing, said cavity having semi-circular ends and being structured and arranged to permit entry into said housing of a curved hasp;

(c) a key activated tumbler disposed within said tumbler access opening;

(d) a bolt, coupled to said tumbler and structured and arranged to be simultaneously engageable with an opening in the upper hasp and an opening in the lower hasp; and (e) a protective portion extending upward from said bottom surface of said housing for a distance of about ¾ inch;

(f) wherein said housing is substantially round and comprises a side surface having a larger diameter adjacent said back surface than adjacent said front surface.

31. The system of claim 30 wherein said semi-circular ends have a diameter of about ¾ inch.

32. The system of claim 30 wherein said protective portion has a thickness extending outwardly from said back surface of said housing for a distance of about ¼ inch.

33. The system of claim 30 further comprising:

(a) a cable attached to said housing and attachable to the semitrailer.

34. The system of claim 33 wherein said cable has a length of about 14 inches and is permanently attached to said housing and permanently attachable to the semitrailer.

35. The system of claim 33 wherein said cable has a length of about 28 inches and is permanently attached to said housing and removably attachable to the semitrailer.

36. The system of claim 30 further comprising:

(a) a seal aperture structured and arranged to bisect said tumbler access opening;

(b) wherein said seal aperture is structured and arranged to receive an elongated portion of a lockable flat seal.

37. The system of claim 30 further comprising:

(a) a circumferential channel formed on said side surface structured and arranged to substantially bisect said tumbler access opening; and (b) wherein said circumferential channel is structured and arranged to receive an elongated portion of a lockable flat seal.

38. A semitrailer cargo door locking system for use with a cargo door of the type having a hasp means, comprising an upper hasp and a lower hasp, for securing a door handle in a closed position, said system comprising, in combination:

(a) a shackleless lock housing having a back surface, a front surface, and a bottom surface;

(b) a first receiver within said shackleless lock housing arranged to receive the hasp means;

(c) a lock disposed within said shackleless lock housing to lock the upper hasp and the lower hasp within said receiver; and, wherein said lock comprises:

(i) a key-activated tumbler; and (ii) a locking bolt coupled to said tumbler and structured and arranged to be simultaneously engageable with an opening in the upper hasp and an opening in the lower hasp; and (d) a tamper evident element, coupled to and outside said shackleless lock housing, arranged to provide a visual indication of potential unlocking of said lock.

39. The system of claim 38 wherein said back surface comprises a contour portion to contour said shackleless lock housing to the contours of the hasp means.

40. The system of claim 39 wherein said contour portion comprises a protective portion extending upward from said bottom surface of said shackleless housing for a distance of about ¾ inch.

41. The system of claim 38 wherein said first receiver comprises cavity formed in said back surface of said shackleless lock housing.

42. The system of claim 41 wherein said cavity comprises semicircular ends structured and arranged to permit entry of a curved hasp.

43. The system of claim 38, further comprising a mooring element to securely moor said shackleless lock housing to the semitrailer.

44. The system of claim 43 wherein said mooring element comprises a cable permanently attached to said shackleless lock housing and attachable to the semitrailer.

45. The system of claim 38 wherein said shackleless housing comprises a side surface having a tumbler access opening.

46. The system of claim 45 further comprising a second receiver arranged to receive said tamper evident element, and wherein said tamper evident element comprises a lockable flat seal of the type having an elongated body.

47. The system of claim 46 wherein said second receiver comprises:

(a) a seal aperture structured and arranged to bisect said tumbler access opening; and (b) wherein said seal aperture is structured and arranged to receive an elongated portion of said lockable flat seal.

48. The system of claim 47 wherein said second receiver comprises:

(a) a circumferential channel formed on said side surface structured and arranged to substantially bisect said tumbler access opening; and (b) wherein said circumferential channel is structured and arranged to receive said elongated portion of said lockable flat seal.

49. The system of claim 48 wherein said circumferential channel is at least as deep as a maximum thickness of said flat seal.

50. The system of claim 48 further comprising a retainer arranged to retain said flat seal within said circumferential channel.

51. The system of claim 50 wherein said retainer comprises at least one retainer element, integrally attached to said side surface, said retainer element being structured and arranged to bisect said circumferential channel.

* * * * *

UNITED STATES PATENT AND TRADEMARK OFFICE

CERTIFICATE OF CORRECTION

PATENT NO. : 6,233,984 B1
DATED : May 22, 2001
INVENTOR(S) : Andrew Blehi, III

It is certified that error appears in the above-identified patent and that said Letters Patent is hereby corrected as shown below:

Title page,
The title, "SEMITRAILER CARGO, DOOR LOCKING SYSTEM" should read -- SEMITRAILER CARGO DOOR LOCKING SYSTEM --.

Claim 5,
Line 2, after "shackleless" insert -- lock --.

Claim 6,
Line 3, before "housing" insert -- lock --.

Claim 8,
Line 3, before "housing" insert -- lock --.

Claim 10,
Line 3, after "shackleless" insert -- lock --.

Claim 11,
Line 3, after "said" insert -- shackleless lock --.

Claim 12,
Line 2, before "housing" insert -- lock --.
Line 2, delete "rounded" and substitute therefor -- round --.

Claim 13,
Line 2, before "housing" insert -- lock --.

Claim 40,
Line 3, after "shackleless" insert -- lock --.

UNITED STATES PATENT AND TRADEMARK OFFICE

CERTIFICATE OF CORRECTION

PATENT NO. : 6,233,984 B1
DATED : May 22, 2001
INVENTOR(S) : Andrew Blehi, III

It is certified that error appears in the above-identified patent and that said Letters Patent is hereby corrected as shown below:

Claim 41,
Line 2, after "comprises" insert -- a --.

Claim 45,
Line 2, before "housing" insert -- lock --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*